United States Patent [19]

Rahal

[11] 4,242,772

[45] Jan. 6, 1981

[54] TRAVERSE ROD DRAPERY HOOK

[76] Inventor: Marcel T. Rahal, 11251 Promenade, Detroit, Mich. 48213

[21] Appl. No.: 951,372

[22] Filed: Oct. 16, 1978

[51] Int. Cl.[2] ..... E05D 13/02

[52] U.S. Cl. ..... 16/93 D; 24/73 CH; 160/126; 160/330; 248/307

[58] Field of Search ..... 16/93 D, 94 D, 95 D, 16/96 D, 87.2; 24/73 GS, 73 CH, 84 R, 86 R, 259 R; 160/126, 330, 123; 248/265, 251, 252, 257, 307; 211/102

[56] References Cited

U.S. PATENT DOCUMENTS

| | | | |
|---|---|---|---|
| 558,707 | 4/1896 | Aurand | 24/73 CH |
| 1,807,100 | 5/1931 | Graff et al. | 24/259 R X |
| 2,552,922 | 5/1951 | Andreou | 24/73 CH |
| 2,762,100 | 9/1956 | Wallney | 24/259 R X |
| 3,321,814 | 5/1967 | Graber | 16/87.2 X |
| 3,636,587 | 1/1972 | Hager et al. | 16/87.2 |
| 4,011,636 | 3/1977 | Malacheski | 24/259 FS X |

FOREIGN PATENT DOCUMENTS

| | | | |
|---|---|---|---|
| 1930940 | 1/1970 | Fed. Rep. of Germany | 16/93 D |

*Primary Examiner*—C. J. Husar
*Assistant Examiner*—Moshe I. Cohen
*Attorney, Agent, or Firm*—Basile, Weintraub & Hanlon

[57] ABSTRACT

A traverse rod drapery hook is attachable to the terminal end of a curtain or drape and includes a member into which the terminal end of the traverse rod telescopes. The hook hereof includes a plate which provides a rigid surface for maintaining the drape in an upright position.

12 Claims, 6 Drawing Figures

TRAVERSE ROD DRAPERY HOOK

BACKGROUND OF THE INVENTION

I. Field of the Invention

The present invention pertains to draperies and curtains. More particularly, the present invention pertains to hooks for draperies and curtains. Even more particularly, the present invention pertains to hooks for draperies and curtains which are particularly adapted for utilization with traverse rods.

II. Prior Art

The suspension of draperies and curtains from traverse rods is, of course, well known. Essentially, a plurality of hooks are used to suspend the curtain or drape from the mounting members associated with the traverse rod. Furthermore, as is known to the skilled artisan, conventionally, the terminal or travelling end of the traverse rod is defined by a metal bar which is laterally displaced from the rod, per se. This enables the opposed travelling ends to meet substantially at the center of the rod without collision.

However, and as is also known to the skilled artisan, the conventional type of hook which is utilized to suspend the curtain from the traverse rod, while being efficacious for the normal mounting member, creates certain problems with respect to the travelling or terminal end. Because of the nature of the construction of the curtain, which is usually pleated, as well as the bar defining the terminal end, the upper portion of the curtain which is connected to the travelling end of the rod, does not maintain its erect or upright position. Rather, there is a rotational moment created which causes the upper end of the curtain to deviate or rotate away from the vertical plane. This is aesthetically unappealing and is quite commonplace.

The reason for this occuring is due to the inherent function and structure of the hook which is ordinarily a thin wire member having certain defined curvatures and bends, which cooperates with a slot or opening formed in the bar. Because of the interrelation of the structure there is this rotational moment about the point of contact between the hook and the bar which causes this deviation of the upper portion of the curtain from the vertical plane.

As will subsequently be detailed the present invention provides a drapery hook which alleviates the problems heretofore encountered in hanging draperies and curtains from traverse rods.

STATEMENT OF RELEVANT ART

To the best of applicant's knowledge the following is the most relevant art pertaining to the present invention:

U.S. Pat. No. 3,095,033, U.S. Pat. No. 2,606,733 and U.S. Pat. No. 1,600,805.

SUMMARY OF THE INVENTION

In accordance with the present invention there is provided a drapery or curtain hook particularly adapted for interconnecting a curtain or drape to the terminal or travelling end of a traverse rod.

The hook hereof, generally, comprises a substantially planar member or plate, means for telescopingly receiving the terminal or travelling end of a traverse rod and means for detachably mounting the hook to a drape or curtain.

The means for detachably mounting the plate portion of the hook comprises a pair of spaced apart bodies formed of a flexible material and having a gap therebetween which is insertable about a pleat formed in the drape in a common mode.

In an alternate embodiment hereof the drapery hook hereof has the means for detachably mounting the hook to a drape or curtain being defined by the cooperation between the planar member and an upstanding wall. The void or space between the plate and the wall is dimensioned to be less than that of the thickness of the drapery or curtain material. Hence, the drapery or curtain is frictionally retained between the plate and the upstanding wall.

For a more complete understanding of the present invention reference is made to the following description and accompanying drawing. In the drawing like reference characters refer to like parts throughout the several views in which:

DESCRIPTION OF THE PREFERRED EMBODIMENTS

Figure 1:
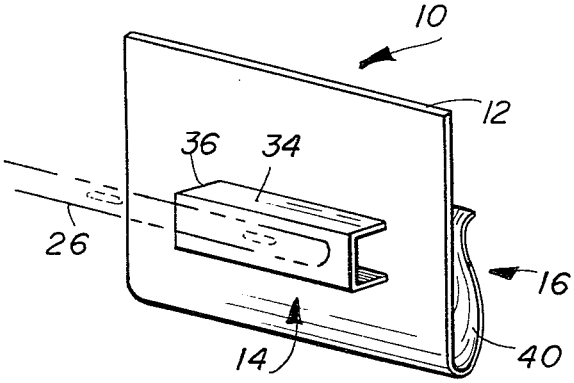
FIG. 1 is a perspective view of a drapery hook in accordance with the present invention.
Figure 3:
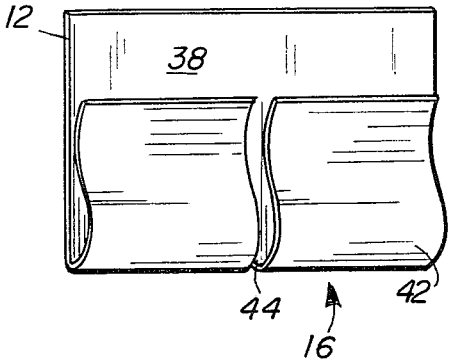
FIG. 3 is a rear elevational view of the drapery hook hereof.
Figure 2:
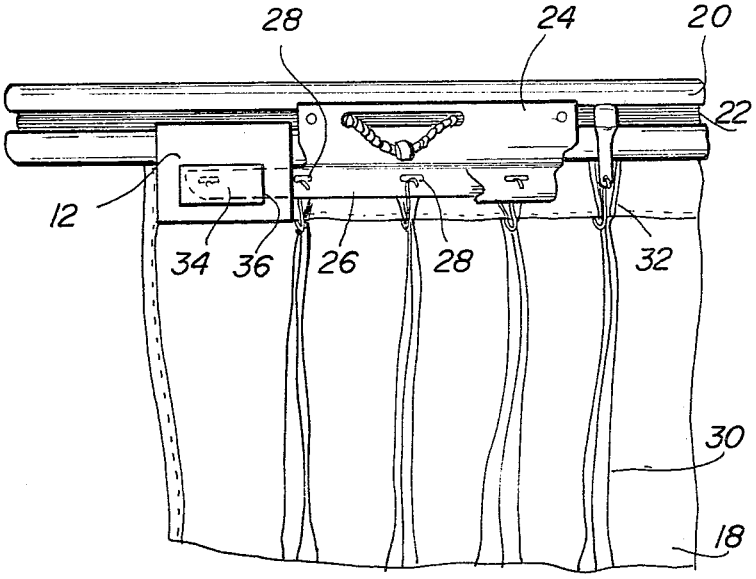
FIG. 2 is an elevational view depicting the utilization of the present drapery hook in the mounting thereof to a traverse rod.
Figure 4:
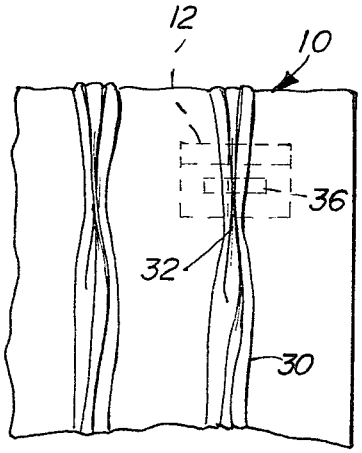
FIG. 4 is an elevational view, depicting in phantom, the interconnection between the present hook and a curtain.

Now, and with reference to the drawing, there is depicted therein a drapery hook, generally, denoted at 10, in accordance with the present invention. The drapery hook hereof generally comprises a substantially planar member or plate 12, means for telescopingly receiving the terminal or travelling end of a traverse rod, generally, denoted at 14 and means 16 for detachably mounting the plate to a drape or curtain.

As is known to those skilled in the art to which the present invention pertains a traverse rod is ordinarily used for suspending pleated curtains or drapes therefrom. Such traverse rods generally include an elongated rod or bar 20 having a track 22 formed therein. A guide rope assembly generally including a pulley is utilized to guide a terminal plate or rod 24 through the track. Conventionally, the terminal end of the traverse rod assembly comprises an elongated bar or rod 26 which has a plurality of slots 28 formed therein. The slots, conventionally, have drapery hooks or the like insertably mounted thereinto.

It is to be understood that in the practice of the present invention, the traverse rod, per se, does not form part of the instant invention. Rather, the present invention is directed to a mode of alleviating the problem hereinabove referred to which occurs ordinarily by virtue of the interconnection which is usually achieved between the rod or bar 26 and a conventional hook. The exact construction of the traverse rod is, of course, well known.

Also, it is to be understood with respect to the present invention that the curtains or drapes 18 are fabric structures usually having a plurality of pleats 30. The pleats, usually, are spaced apart and vertically extending. Usually, the upper terminis of the drape has individual pleat material sewn together. Ordinarily, in mounting a drapery hook to a drape the hook is mounted about the situs of the sewing together of the pleats such as at 32. Again, this is known to the skilled artisan.

Referring again to the drawing the hook 10 hereof, as noted, includes a plate 12. The plate 12 is a rigid surface which is interposed between the traverse rod and the drape or curtain. The plate 12, in essence, provides a bearing surface to preclude rotation of the drape away from the terminal or travelling end of the traverse rod 26.

Projecting laterally outwardly from a first surface of the plate 12 is the means 14 for telescopingly receiving the terminal end 26 of the traverse rod. The means 14 generally is defined by a conduit 34 which is dimensioned to slidingly and insertingly receive the end of the elongated rod 26. The conduit 34 is an elongated body having at least one open end 36 through which the rod 26 is inserted. The conduit 34, as noted, is dimensioned to retain the rod 26 therewithin. By nesting the rod 26 within the conduit 34 pivotal rotation of the hook about the rod is substantially totally diminished thereby precluding the curtain from rotating away from its normal vertical plane.

In a preferred embodiment of the present invention, the conduit 34 is integrally formed with the plate 12, and, as noted projects laterally outwardly therefrom. The conduit can have any desired configuration such as a rectangle, cylinder or the like.

The hook 10 is detachably interconnected to a curtain or drape via means 16. The means 16 generally comprises a clamp or the like for pinching the body of the curtain or drape 18 between the opposed surfaces 38 and 40 of the plate 12 and the means 16, respectively.

The means 16 generally comprises a body 42 having a width substantially equal to that of the plate 12 and is integrally formed therewith. The body has a slit or gap 44 formed centrally thereof which is employed to envelop the pleat area or situs 32 in the well known manner. The means 16 can have any desired configuration but, optimally, has a sinusoidal configuration to bring the body into proximity with the surface 38 in order to effectuate the "pinching". The means 16 is ordinarily integrally formed with the plate 12 and overlies a substantial portion thereof, as shown.

The means 16 is formed from a non-resilient material in order to exert the compressive forces necessary to maintain the curtain or drape in a suspended state.

Optimally, the hook 10 hereof is formed as a unitary member comprising the plate, the means for telescopingly receiving the rod 26 as well as the means 16. Furthermore, the device hereof is, preferably, integrally formed from a synthetic resinous material such as a rigid nylon, polyvinyl chloride, or the like.

It is to be appreciated that the hook hereof, by virtue of the width of the plate 12, cooperates with the conduit 34 to prevent the rotational movement of the upper portion of the curtain away from the elongated rod of the terminal or travelling end of the traverse rod. Hence, the curtain or drape remains in its normal vertical plane.

Figure 5:
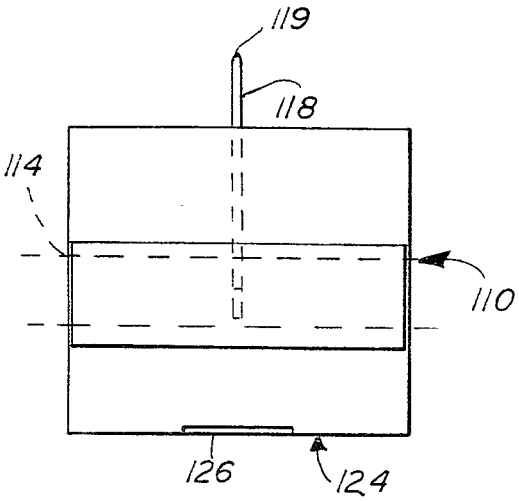
FIG. 5 is a front elevational view of an alternate embodiment of the present invention.
Figure 6:
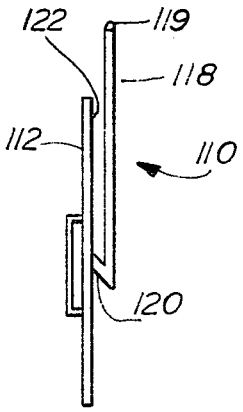
FIG. 6 is a side elevational view of the embodiment of FIG. 5.

Referring now to FIGS. 5 and 6 there is depicted therein an alternate embodiment of the present invention, generally denoted at 110. In accordance herewith there is provided a substantially planar member of plate 112, means for telescopingly receiving the terminal or travelling end of a traverse rod 114 and means for detachably mounting the plate to a drape or curtain. It should be noted in this regard that this embodiment of the present invention is substantially the same as that defined hereinabove. The major difference between this embodiment and that heretofore described is with respect to the means for detachably mounting the plate to a drape or curtain. In all other respects this embodiment is substantially the same as that heretofore described.

This means generally comprises an upstanding pin 118 which is substantially parallel to the plate 112. The pin 118 has a width less than that of the plate 112 and projects thereabove, as shown. The pin 118 terminates in a point 119 for penetrating the material to suspend the hoof hereof to the curtain or drape. The pin 118 is interconnected to the plate 112 via an interconnecting leg 120. The leg 120 is optimally, integrally formed with the pin 118, as well as with the plate or planar member 112.

A space 122 is, thus, created between the plate 112 and the pin 118. In accordance herewith the space 122 is less than that of the thickness of the fabric of the curtain or drape. Hence, in utilizing this embodiment of the present invention the portion of the fabric defining the hem of the curtain is retained in the space 122 by virtue of the pinning action. Likewise, frictional forces retain the material within the space 122 by virtue of the compressive forces being exerted thereagainst by the pin 118 and the plate 112. This embodiment of the invention negates the need for insertion about the pleat.

Also, in accordance with the present invention there is provided means for grasping the hook generally denoted at 124. The means 124 generally comprises a projecting lip 126 or the like which can be manually grasped to facilitate both mounting and de-mounting of the hook from the curtain.

It is to be appreciated that a plurality of pins 118 can be provided as the means for detachably interconnecting the hook to the material. In such instance the pins would be spaced apart and project in the manner described above with respect to the single pin 118.

As with the first embodiment of the present invention this hook can be integrally formed in a single molding operation when formed of a synthetic resinous material. Likewise metals, such as steel, aluminum or the like can be used to fabricate the hook hereof.

It is to be appreciated from the preceding that there has been described herein an improved drapery hook for traverse rods which overcomes the deficiencies noted in the prior art. Having, thus, described the invention what is claimed is:

I claim:

1. A drapery hook for suspending a drapery from a traverse rod having a travelling bracket thereon, comprising:

a. a support plate, forming part of said hook b. means on said plate telescopingly receiving the travelling bracket of the traverse rod, said receiving means configured to prevent rotation of the hook about the bracket of the traverse rod, and c. means for detachably interconnecting the hook to a drapery.

2. The drapery hook of claim 1 wherein:

the means for telescopingly receiving comprises a conduit formed on the support plate.

3. The drapery hook of claim 1 wherein:

(a) the means for telescopingly receiving comprises a conduit formed on the support plate, (b) the means for detachably interconnecting comprises a body integral with and overlying the support plate and cooperating therewith to pinch the drapery therebetween, the body having a slit formed therein for enveloping a pleat area of the drapery, and (c) further wherein the body has a sinusoidal configuration along its longitudinal extent.

4. The drapery hook of claim 1 which further comprises:

means for grasping the hook integrally formed therewith and projecting radially outwardly therefrom.

5. The drapery hook of claim 1 wherein:

the means for detachably interconnecting comprises a pin spaced apart from and connected to the support plate.

6. The drapery hook of claim 1 wherein:

the means for detachably interconnecting comprises a body overlying the support plate, the body cooperating with the plate to pinch the drapery therebetween.

7. The drapery hook of claim 6 wherein:

the body has a slit formed therein, the slit enveloping a pleat area formed in the drapery.

8. The drapery hook of claim 6 wherein:

the body has a sinusoidal configuration along its longitudinal extent.

9. The drapery hook of claim 6 wherein:

the body is integrally formed with the support plate.

10. The drapery hook of claim 6 wherein:

the means for telescopingly receiving comprises a conduit formed on the support plate.

11. The drapery hook of claim 1 wherein:

the means for detachably interconnecting the hook to a drapery comprises a wall spaced apart from, and substantially parallel to the support plate, the plate and the wall cooperating to define a space therebetween which is less than the thickness of a drapery to frictionally retain the drapery therewithin, and means interconnecting the wall to the support plate.

12. The drapery hook of claim 11 wherein:

the means interconnecting the wall to the support plate comprises a leg extending between the wall and the support plate and being integrally formed therewith.

* * * * *